US007007951B1

(12) United States Patent
Glanzmann

(10) Patent No.: US 7,007,951 B1
(45) Date of Patent: Mar. 7, 2006

(54) TRANSPORT DISC FOR AN OPENING DEVICE OF A PRINTED SHEET FEEDER

(75) Inventor: Alfred Glanzmann, Reiden (CH)

(73) Assignee: GRAPHA-Holding AG, Hergiswil (CH)

( * ) Notice: Subject to any disclaimer, the term of this patent is extended or adjusted under 35 U.S.C. 154(b) by 546 days.

(21) Appl. No.: 09/579,901

(22) Filed: May 26, 2000

(30) Foreign Application Priority Data

Jun. 4, 1999 (EP) ..... 99810492

(51) Int. Cl.
*B65H 29/20* (2006.01)

(52) U.S. Cl. ..... 271/315; 270/52.27; 270/52.28

(58) Field of Classification Search ..... 270/52.27, 270/52.28, 45, 52.21; 271/314, 315, 82, 271/83

See application file for complete search history.

(56) References Cited

U.S. PATENT DOCUMENTS 2,413,358 A * 12/1946 Kleineberg ..... 270/52.29
3,371,924 A * 3/1968 Nelson et al. ..... 270/52.21
3,572,684 A * 3/1971 Gorig ..... 270/52.28
3,806,111 A * 4/1974 Lachman et al. ..... 270/52.28
3,809,384 A * 5/1974 Zugel ..... 270/52.28
4,287,649 A 9/1981 Kohler
5,026,045 A * 6/1991 Wirtz et al. ..... 271/82 X
5,048,809 A * 9/1991 Tebbe et al. ..... 270/45
6,000,336 A * 12/1999 Leib ..... 271/182 X

FOREIGN PATENT DOCUMENTS

| | | |
|---|---|---|
| DE | 1761771 | 8/1971 |
| DE | 3902923 | 10/1989 |
| EP | 0663363 | 7/1995 |
| EP | 0663363 A1 * | 7/1995 |
| EP | 0775661 | 5/1997 |

* cited by examiner

*Primary Examiner*—Patrick Mackey
(74) *Attorney, Agent, or Firm*—Friedrich Kueffner

(57) ABSTRACT

A transport disc for an opening device of a printed sheet feeder is arranged on a first opening drum of the opening device and has at least one outer elastic support. The outer elastic support cooperates with a securing disc of a second opening drum of the opening device to clamp an individual printed sheet between the outer elastic support and the securing disc for transporting the individual printed sheet to a transport device. The outer elastic support has an outer bearing layer and a compensation area positioned radially inwardly underneath the outer bearing layer. The compensation area is radially yielding and supports the outer bearing layer.

10 Claims, 4 Drawing Sheets

TRANSPORT DISC FOR AN OPENING DEVICE OF A PRINTED SHEET FEEDER

BACKGROUND OF THE INVENTION

1. Field of the Invention

The invention relates to a transport disc for an opening device of a printed sheet feeder, wherein such a transport disc is arranged on one or both opening drums of the opening device and has at its circumference an outer elastic support. An individual printed sheet can be clamped for its transport to a transport device between the elastic support and the disc of another opening drum.

2. Description of the Related Art

Feeders are provided to open the printed sheet removed from a stack and to place it onto a transport device, especially a collecting chain. For opening the printed sheet, such feeders have two opening drums B and C which grip the printed sheet to be opened respectively at the free sheet ends and open it. After opening of the sheet, the grippers or suction devices release the ends of the sheet. After release from the grippers or suction devices, it is important that the printed sheets are transported farther by transport discs until they fall onto the collecting chain in an astride position.

Feeders, and especially gather-stitcher feeders, must generally be able to process printed products of different thickness and also of various paper types. The transport discs accordingly must be able to safely transport respective products of different thickness. The transport discs thus not only must be able to receive different products of different thickness, but also to clamp very thin and unstable products with sufficient clamping force so that the sheets are transported and placed geometrically precisely onto the collecting chain.

In the prior art transport discs are known which have an elastic support made of a silicone hose about their circumference. The silicone hose is radially compressed according to the thickness of the products. Such a silicone hose presents problems in that it is difficult to fasten such a silicone hose on the body of the transport discs. Moreover, the clamping force which is exerted by the silicone hose is difficult to control. Alternatively, supports made of strip-shaped cellular rubber are known. The strips are glued onto the body of the transport disc. Depending on the cellular rubber density, the pressing forces can vary greatly. Moreover, this support is very susceptible to wear and tear and is not flexible. This support therefore must be exchanged frequently in a comparatively rather complicated manner.

SUMMARY OF THE INVENTION

It is an object of the present invention to provide a transport disc of the aforementioned kind which avoids the aforementioned difficulties.

In accordance with the present invention, this is achieved in that the outer elastic support has an outer bearing layer and, positioned underneath, a compensation area which is yieldingly active in the radial direction and is designed to support the outer bearing layer.

Accordingly, in the transport disc according to the present invention, radially underneath the outer bearing layer a compensation area is provided which in the radial direction is significantly more elastic than the outer bearing layer.

The adaptation to different product thickness is realized by a radial compression of this compensation area. The outer bearing layer can therefore be produced of a plastic material which is comparatively wear-resistant and stable. The thickness compensation, as mentioned above, takes place in the compensation area underneath. The radial deformation can be comparatively large and, for example, is within a range of 8 to 10 mm. The radial thickness of the outer bearing layer is, for example, 4 to 8 mm, preferably approximately 6 mm. Due to the comparatively tall deformation area, it is possible to transport very thin and sensitive products as well as thick products of solid paper.

According to a further embodiment of the invention, the compensation area is formed by several spoke-like stays. The stays can support the outer bearing layer especially reliably and safely in the radial as well as axial direction when these spoke-like stays are disc-shaped or lamella-shaped.

These stays moreover allow a very elastic deformation within a wide radial length range.

This can be further enhanced by the arrangement of these stays at a slant to the radial direction, pursuant to a further development.

According to another further development of the invention, radially below the compensation area an inner layer is arranged which has means for fastening the elastic support to a body of the transport disc.

Fastening is realized, for example, by means of screws. This allows a simple and comparatively fast exchange of the elastic support. However, also conceivable is an embodiment in which the elastic support is directly fastened to the body of the transport disc, for example, by casting or vulcanization.

DESCRIPTION OF THE PREFERRED EMBODIMENTS

Figure 1:
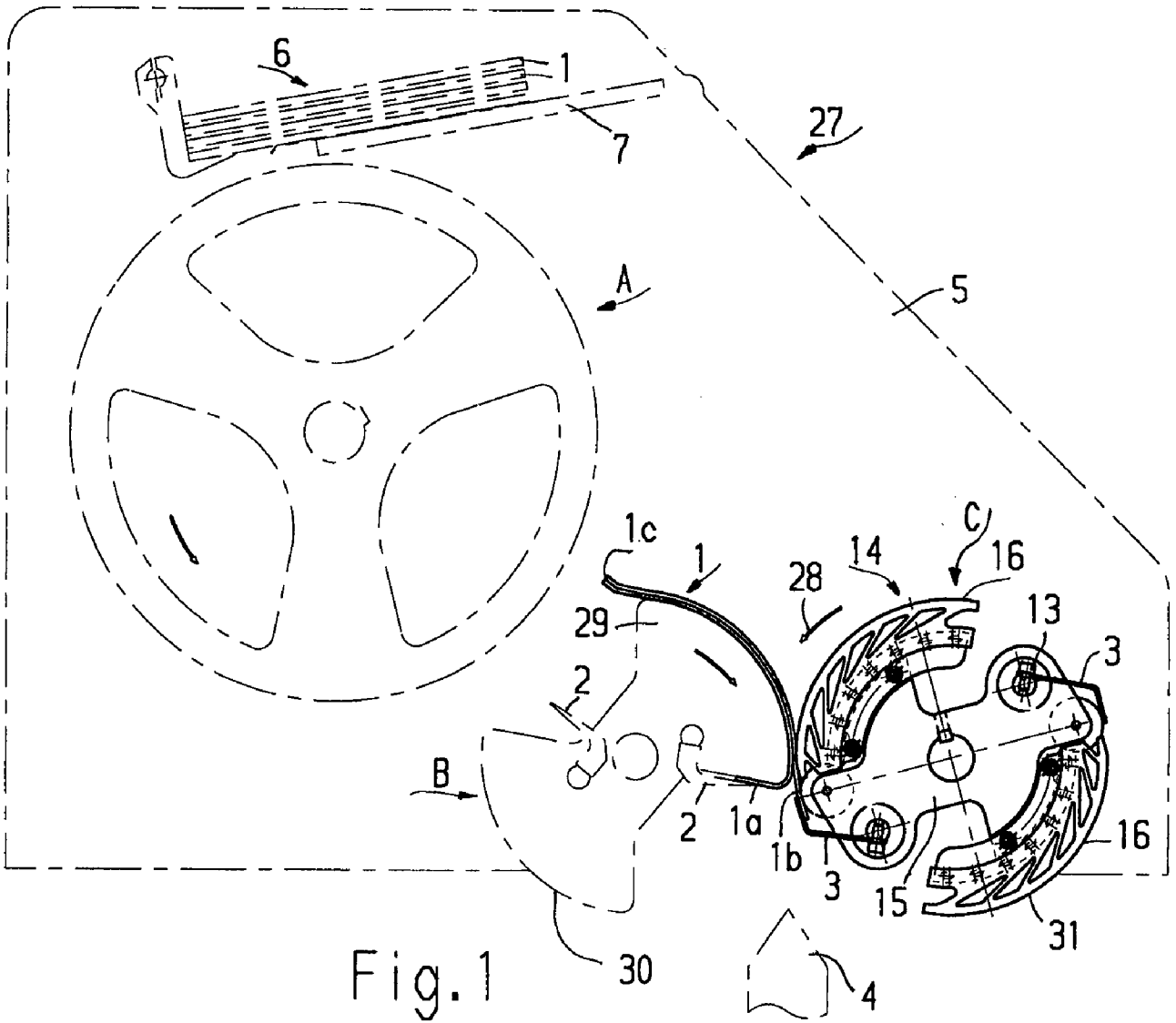
FIG. 1 shows schematically the parts of a feeder comprising a transport disc according to the invention.

FIG. 1 shows schematically a feeder 27 for folded printed sheets to be opened, wherein the feeder is especially a gather-stitcher feeder, with which the folded printed sheets 1 are removed individually from the underside of a stack 6 by means of a drum A and, as is known in the prior art, are fed to an opening drum B and an opening drum C. The stack 6 is arranged above the drum A on a support frame 7, and the respectively lowermost printed sheet is removed, for example, by grippers or suction devices (not shown). The transport of the printed sheet 1 from the stack 6 to the two cooperating opening drums B and C is known to a person skilled in the art and will therefore not be explained in more detail in this context. The drums A through C are supported on opposed bearing plates 5 and are driven in precise working cycles by drive means (not shown). The drum A rotates in FIG. 1 in the counterclockwise direction, the drum B rotates in the clockwise direction, and the drum C rotates, according to arrow 28, in the counterclockwise direction.

FIG. 1 shows a folded sheet 1 which is gripped by grippers 2 of the opening drum B at its free leading partial sheet end 1*a* and is simultaneously also gripped by the grippers 3 of the drum C at the other free leading partial sheet end 1*b*. The folded back 1*c* of the printed sheet follows. A collecting chain 4 known in the art, or any other type of transport device known in the art, is located between the two opening drums B and C and underneath them. FIG. 1 shows the beginning of the opening process. Upon further rotation of the two drums B and C, the printed sheet 1 is opened wider and, after the grippers 2 and 3 have released the printed sheet 1, the printed sheet 1 is transported father downwardly and then dropped astride onto the collecting chain 4. The circulating collecting chain 4 transports the printed sheet 1, for example, to a stitching device (not shown).

Since the printed sheet 1 is opened and transported at a comparatively high velocity, it is important that the printed sheets are geometrically precisely guided when dropping them onto the collecting chain 4. For this purpose, the printed sheets are clamped between the opening drums B and C between at least one securing disc 29 of the opening drum B and a transport disc 14 of the opening drum C. Clamping is realized on circular arc portions 30 and 31 on the circumference of the disc 29, respectively, of the transport disc 14. These surfaces 30 and 31 are preferably cylindrical surfaces.

In order for printed sheets 1 of different thickness to be transportable on the transport disc 14, the transport disc 14 has two segment-like supports 16. Between these elastic supports 16, as can be seen in the drawing, grippers 3 are provided on the circumference of the transport disc 14.

However, conceivable is also an embodiment in which only one support 16 or more than two supports 16 are provided.

Figure 2:
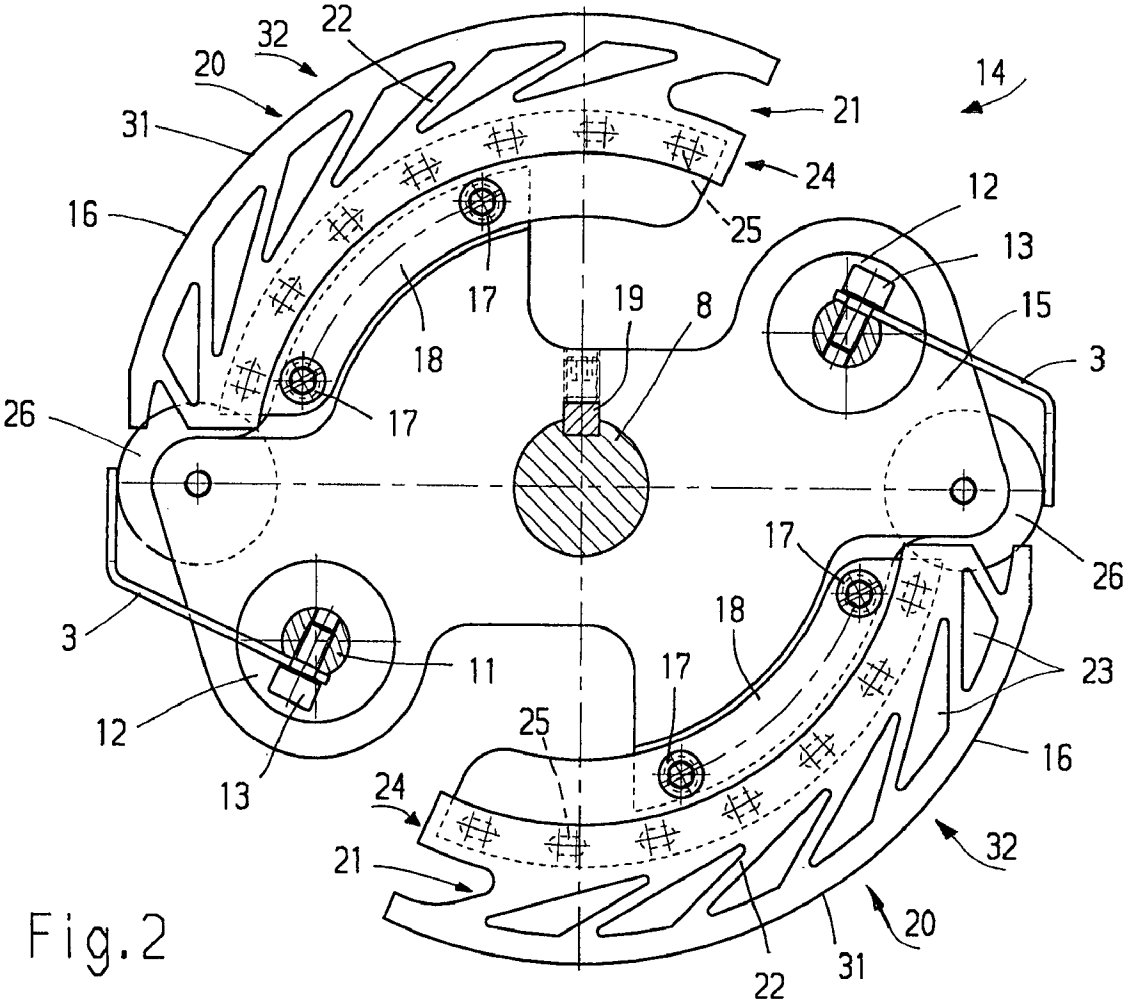
FIG. 2 shows an end view of the transport disc according to the invention.

The two supports 16 according to FIG. 2 are connected by screws 17 to a disc-shaped body 15 of the transport disc 14. On the body 15 two clamping rollers 29 are supported between the elastic supports 16 which cooperate respectively with a gripper 3 for gripping an end of the printed sheet 1*b* in a manner known to a person skilled in the art. The actuation of the two grippers 3 is realized respectively by a shaft 11 on which the grippers 3 are respectively fastened by a screw 13. The shafts 11 are arranged respectively in a bearing 12 on the transport disc 14 and can be rotated by a cam disc (not shown) for actuating the grippers 3 in a manner known to a person skilled in the art.

Figure 3:
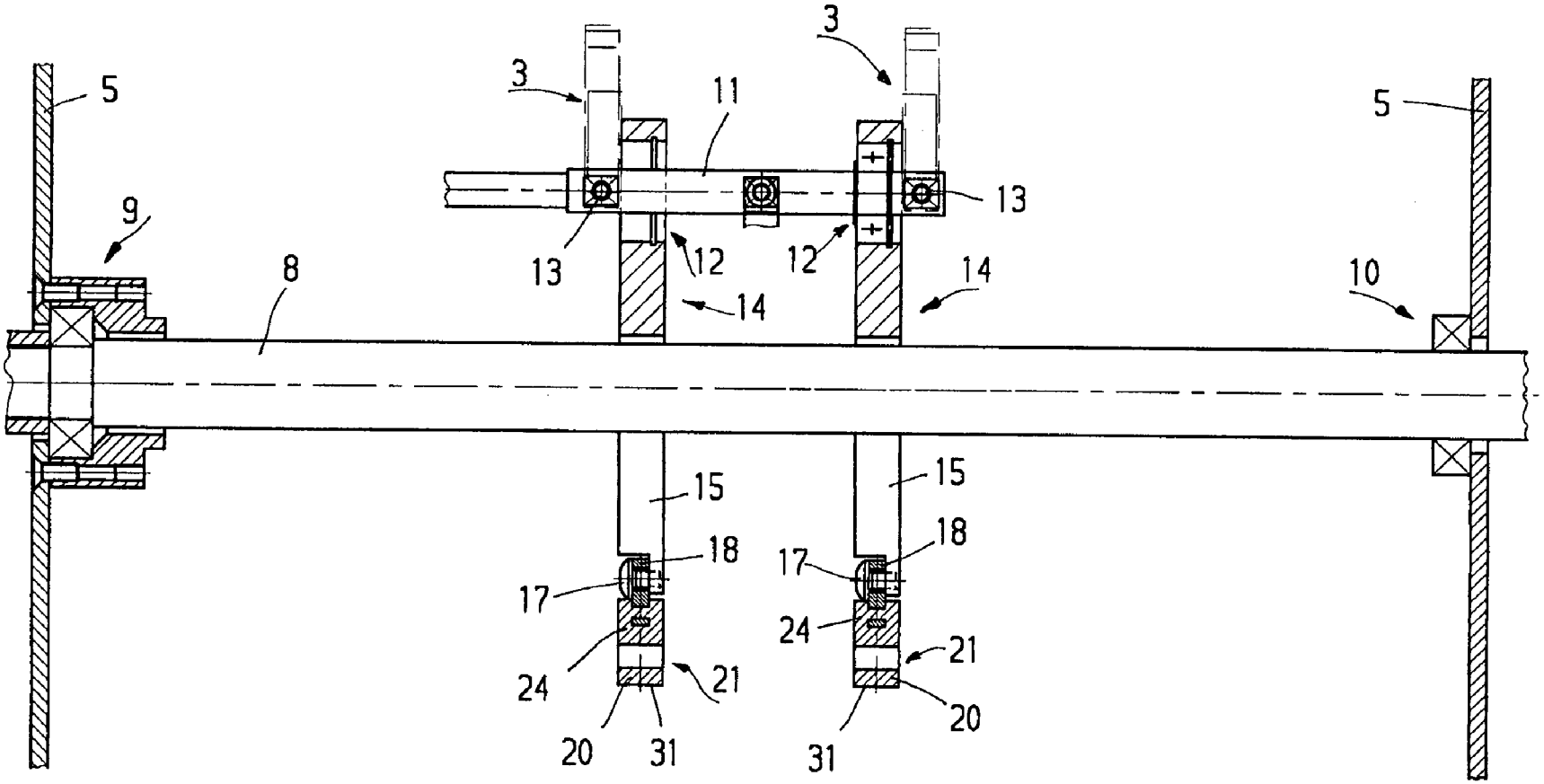
FIG. 3 shows schematically a sectional view of the opening drum of the feeder.

As is conventional, two transport discs 14 are positioned on the shaft 8 in a spaced apart arrangement (see FIG. 3). As is shown in FIG. 2, these transport discs 14 are secured respectively by a wedge 19 on the shaft 8. The shaft 8, according to FIG. 3, is fastened with bearings 9 and 10 on the two bearing plates 5 and is driven in a manner known to a person skilled in the art. The shaft 11, as is illustrated, operates simultaneously the grippers of both transport discs 14.

The elastic supports 16 are preferably of identical design and comprise a preferably rubber-elastic segment body 32 which is cast onto a curved or arc-shaped carrier 18, for example, comprised of sheet metal, arranged at the inner side. In order for the rubber-elastic body 32 to be securely held on the carrier 18, the carrier 18 is provided with penetrations 25 where the rubber-elastic body 32 is anchored. By means of screws 17 the elastic supports 16 are detachably connected to the circumference of the body 15. However, other fastening means are also possible. The supports 16 can also be directly cast onto the body 15.

The segment bodies 32 comprise respectively an outer bearing layer 20, a central compensation area 21, as well as an inner layer 24. The compensation area 21 is preferably formed by several spoke-like stays 22 which connect the two layers 20 and 24 with one another. The spokes 22 are preferably lamella-shaped or ledge-shaped and extend, according to FIG. 3, preferably over the entire width of the elastic supports 16. Instead of spokes, an annular stay connection (i.e., a double T cross-section) could be provided between the outer bearing layer 20 and the inner layer 24. It is now important that the compensation area 21 is elastically deformable in the radial direction within a comparatively large range. The outer bearing layer 20 is significantly less deformed during such a radial deformation and maintains its stability. The deformation area of the compensation layer 21, as mentioned before, is comparatively tall and is, for example, 0 to 7 mm. Accordingly, between the two opening drums B and C products up to a thickness of approximately 7 mm can be transported. In the case of a very thin printed sheet, the deformation in the compensation area 21 is correspondingly minimal. Such thin and light printed sheets 1 are satisfactorily secured with a comparatively minimal clamping force. For a greater deformation in the compensation area 21 a higher clamping force is exerted on thicker printed sheets 1. At maximum deformation, the intermediate spaces 23 between the stays 22 are substantially closed and the bearing layer 20 is accordingly moved radially inwardly.

The rubber-elastic segment body 32 is comprised preferably of a comparatively wear-resistant plastic material. An especially suitable plastic material is polyurethane, and more preferred is a castable polyurethane. Such a polyurethane material is commercially available under the trademark VULKOLLAN. Such a plastic material acts radially yielding in the segment bodies 32 and regains its original shape very quickly when the load is removed.

Figure 4A:
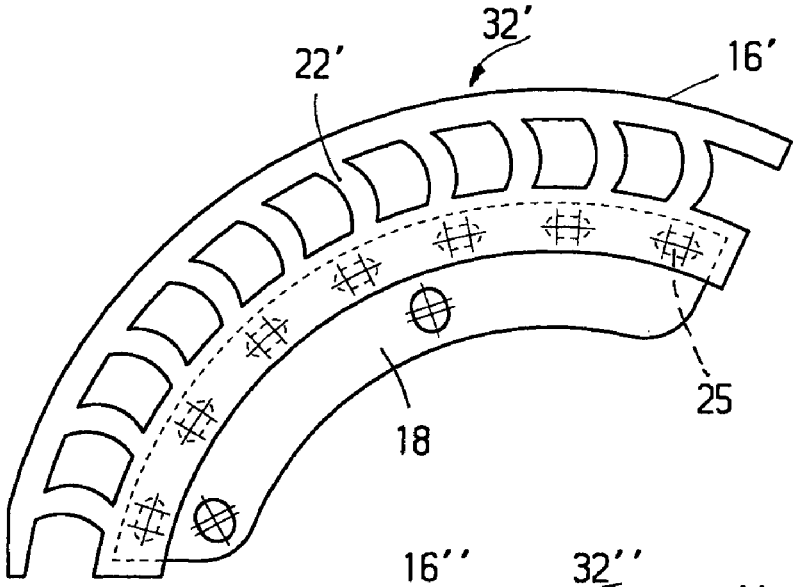
FIGS. 4*a* to 4*c* show variations of a suitable elastic support of the transport disc according to the invention.
Figure 4B:
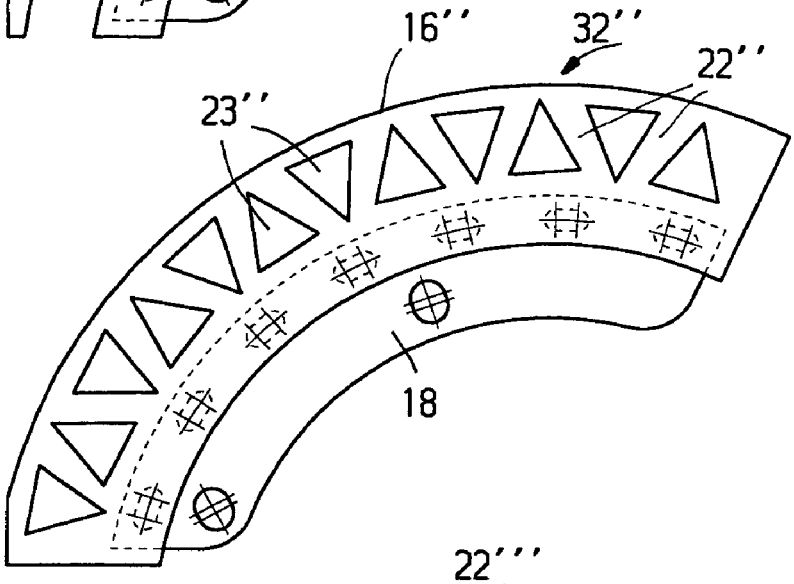
Figure 4C:
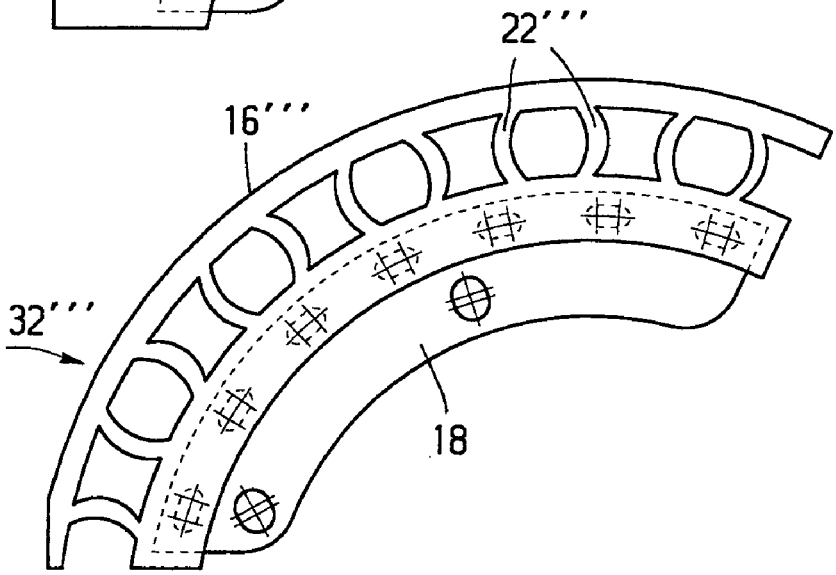

The FIGS. 4*a* through 4*c* show elastic supports 16', 16", and 16'" according to variants of the present invention. With respect to the above disclosed embodiment, only the body 32', 32" or 32'" is different. In the embodiment according to FIG. 4*a* the stays 22' have a substantially radial extension and are arc-shaped. In the embodiment according to FIG. 4*b* the stays 22" are arranged such that the intermediate spaces 23" are approximately triangular. In the embodiment according to FIG. 4*c* radially extending and arc shaped stays 22'" are also used but in an arrangement different from that of FIG. 4*a*. Conceivable is finally also an arrangement in which no intermediate spaces 23 are provided. The compensation area 21 is then formed by a plastic material which is substantially more elastic than the outer bearing layer 20. The intermediate spaces 23 can moreover be filled with a rubber-elastic plastic material.

Of course, it is also possible to provide the opening drum B (in addition to the drum C) with the transport disc 14 according to the invention or to provide only the opening drum B with the transport disc 14 according to the invention.

While specific embodiments of the invention have been shown and described in detail to illustrate the inventive principles, it will be understood that the invention may be embodied otherwise without departing from such principles.

What is claimed is:

1. A transport disc for an opening device of a printed sheet feeder, the transport disc configured to be arranged on a first opening drum of the opening device, the transport disc comprising:

at least one outer elastic support, wherein the outer elastic support is configured to cooperate with a securing disc of a second opening drum of the opening device to clamp an individual printed sheet between the outer elastic support and the securing disc for transporting the individual printed sheet to a transport device, wherein the outer elastic support is a rubber-elastic segment body extending in a circumferential direction of the transport disc, and wherein the rubber-elastic segment body is comprised of an outer bearing layer and a compensation area positioned radially inwardly underneath the outer bearing layer, wherein the compensation area is radially yielding and supports the outer bearing layer, the compensation area being more elastic in the radial direction than the outer bearing layer, the compensation area having a plurality of stays each having a first end connected to the outer bearing layer and each having a second end positioned radially inwardly of the respective first end, the stays being formed as ledges or lamellas, the stays being positioned at a slant to a radial line extending in a radial direction from the first end to a center of the transport disc, respectively.

2. The transport disc according to claim 1, wherein the compensation area has a radial compression area having a radial thickness matching at least substantially a radial thickness of the outer bearing layer.

3. The transport disc according to claim 2, further comprising a disc body, wherein the outer elastic support further comprises an inner layer positioned radially inwardly of the compensation area, wherein the inner layer comprises means for fastening the outer elastic support to the disc body.

4. The transport disc according to claim 1, wherein the rubber-elastic segment body is made of polyurethane.

5. The transport disc according to claim 4, wherein the polyurethane is castable.

6. The transport disc according to claim 1, further comprising a disc body, wherein the rubber-elastic segment body is configured to be fixedly connected to the disc body.

7. The transport disc according to claim 1, wherein the outer elastic support is made of a rubber-elastic plastic material.

8. The transport disc according to claim 1, further comprising a disc body, wherein the outer elastic support is configured to be detachably connected to the disc body.

9. The transport disc according to claim 8, wherein the outer elastic support is connected to the disc body by screws.

10. The transport disc according to claim 1, wherein the printed sheet feeder is a gather-stitcher feeder and the transport disc is connected to a shaft of the first opening drum.

* * * * *